US005389748A

United States Patent [19]

Burke et al.

[11] Patent Number: 5,389,748

[45] Date of Patent: Feb. 14, 1995

[54] METHOD AND APPARATUS FOR MODERNIZING THE CONTROL OF AN ELEVATOR GROUP

[75] Inventors: Richard J. Burke, Westwood; Robert J. Platt, Randolph; Kenneth T. May, Little Falls, all of N.J.

[73] Assignee: Inventio AG, Hergiswil NW, Switzerland

[21] Appl. No.: 74,213

[22] Filed: Jun. 9, 1993

[51] Int. Cl.[6] ..... B66B 1/14

[52] U.S. Cl. ..... 187/247; 187/382; 187/380

[58] Field of Search ..... 187/101, 100, 102, 130, 187/121, 124

[56] References Cited

U.S. PATENT DOCUMENTS

| | | | |
|---|---|---|---|
| 4,195,712 | 4/1980 | Kuhl | 187/101 |
| 4,724,931 | 2/1988 | Ichioka | 187/101 |
| 4,844,204 | 7/1989 | Ovaska et al. | 187/101 |
| 4,989,695 | 2/1991 | Kubo | 187/101 |
| 5,010,472 | 4/1991 | Yoenda et al. | 364/148 |

FOREIGN PATENT DOCUMENTS

| | | | |
|---|---|---|---|
| 3509223 | 9/1985 | Germany . | |
| 3-186579 | 8/1991 | Japan | 187/101 |

*Primary Examiner*—Steven L. Stephan
*Assistant Examiner*—Robert Nappi
*Attorney, Agent, or Firm*—Howard & Howard Atty.

[57] ABSTRACT

An apparatus for use during modernization of a group of elevators to maintain optimum service to a building includes an Interim Traffic Manager (ITM) system which evenly distributes hall call routing between old and new elevator controls. During the time that an elevator to be re-equipped is out of service, the original not yet re-equipped elevators, as well as the already re-equipped elevators, respond as a single bank, one elevator car per call. The ITM system is connected between the hall call registering devices and each of old and new elevator controls. When a floor push button is pressed, the ITM system uses a routing algorithm to decide whether to send the call to the old or to the new elevator control based upon traffic loading. The ITM system is an inexpensive, reusable unit which resides on the job site temporarily and, therefore, adds no additional costs to the modernization of an elevator group. Technical knowledge required for the installation of the ITM system is restricted to connecting wiring to the elevator controls and the hall call registering devices.

16 Claims, 6 Drawing Sheets

METHOD AND APPARATUS FOR MODERNIZING THE CONTROL OF AN ELEVATOR GROUP

BACKGROUND OF THE INVENTION

The present invention relates generally to elevator group controls and, in particular, to a method and apparatus for modernizing the control of an existing group elevator control.

During the modernization of an older group elevator control, wherein the older elevator controls are replaced with new controls, a method of providing optimum elevator service to the building is required. Unless other provisions are made, the serving of hall calls is restricted to either the elevator cars of the group still connected to the original group control or the elevator cars of the group connected to the updated group control which reduces the conveying capacity of the elevator group and thereby leads to prolonged waiting times. Various methods of handling this problem are known from the prior art. In a first method, new and old push button hall call fixtures are located at each floor during the changeover period. This method, however, allows the passenger to select his preference and therefore may cause traffic loading imbalance. Also, some passengers might select a push button on each fixture requiring elevator cars from each system to answer a single hall call. Furthermore, the presence of two push button fixtures on each floor may lead to passenger confusion.

In a second method, preferably applicable to older systems, during the changeover period, the elevator cars connected to the original and the updated group controls are adjusted to serve separate floors, so that two elevator cars would not be assigned to answer identical hall calls. One basic drawback to this method is that when one control has a malfunction, floors assigned to that control are not served. Moreover, the push button fixture wiring has to be relocated depending on which group control each floor has been assigned to. In addition, heavy demand floors like lobby or restaurant floors are served inefficiently.

In another method, during the changeover period, the original group control and the updated group control are interconnected to allow all elevator cars to see the same hall call. Unless the voltage supplies for the original and the updated controls are similar, which seldom is the case, the relay dispatch panels have to be hard wire interconnected and voltage interface relays are necessary. It also is disadvantageous in that a hall call is seen by both controls and, therefore, a car from each group is assigned to serve each hall call. The car which arrives first causes the call to be cancelled, while the second car has to make a false stop. This method cannot be used when the updated elevators are under distributed control, i.e., in microprocessor-based systems.

Finally, an overlay method has been used wherein, during the changeover period, the elevators connected to the original group control are overlaid with the same control strategy as the updated group control. One major drawback to this method is that the old control must be changed to enable it to be accessed by the newer system circuitry which may present problems since the designers of the newer system control may not understand the original design strategy. As overlaying an existing control provides an opportunity for causing extensive damage, this method requires the design engineer and the installation technician to have a detailed understanding of the existing control method. It is a further disadvantage of the overlay method that it necessitates extensive modification of existing controls. Such modification may require several days of field labor per car, whereas the overlay equipment is probably discarded upon completion of the modernization. Thus, the overlay method is expensive.

A more recent innovation is described in the German Patent No. DE 35 09 223 which shows a method and equipment in which adaptation computers make the existing old elevator group control compatible with the new group control to be installed. However, an adaptation computer is required for each elevator car of the elevator group to be modernized. The adaptation computers and the new group control are connected with each other in the elevator group to be modernized such that the adaptation computers follow the operation of the old elevator control, but cannot control this operation. The changeover of the individual elevator cars takes place in a three step process. An elevator car to be re-equipped is first taken out of service, then subordinated to the new group control in that the output lines of the corresponding adaptation computer are connected with the control lines of the associated elevator control unit, and finally placed into operation under the control of the new group control. This three step process is repeated for each elevator car until all cars are connected to the new group control and the modernization of the elevator group is concluded.

Since the last described method requires a permanently installed adaptation computer for each elevator car of the elevator group to be modernized, the basic disadvantage is that the method and the apparatus are relatively expensive. This applies particularly when the control device of the elevator itself, for example the control of the old drive or the equipment in the shaft, is also modernized at the same time as the group control. In this case, it would be advantageous to use control elements which are compatible with one another so that permanently installed expensive adaptation computers and their programming could be eliminated. A further disadvantage results from the special knowledge that is required for the configuration of the adaptation computers and that the operation of both old and the new control elements must be known in detail. This method also includes a substantial change in the existing control system which is a risk for the operating and safety functions.

SUMMARY OF THE INVENTION

The present invention concerns an apparatus for use during modernization of a group of elevators to maintain optimum service to a building including an Interim Traffic Manager (ITM) system which evenly distributes hall call routing between old and new elevator controls. A group of elevators having several elevators for serving a plurality of floor landings in a building typically includes push button call registering devices which are located on the floors for entering hall calls for desired floors and a group control responsive to the hall calls and to signals indicative of conditions of each of the elevator cars for providing an assignment of the hall calls to the cars. During modernization of the group, each elevator is temporarily taken out of operation to be re-equipped while the remaining operationally capable elevators are operated together as a group.

The ITM system is connected between the hall call registering devices and each of old and new elevator group controls. When a floor push button is pressed, the ITM system uses a routing algorithm to decide whether to send the call to the old or to the new group control based upon traffic loading. The ITM system is an inexpensive, reusable unit which resides on the job site temporarily and, therefore, adds no additional costs to the modernization of an elevator group. Technical knowledge required for the installation of the ITM system is restricted to connecting wiring to the group controls and the hall call registering devices.

Accordingly, the present invention provides a method and an apparatus for the modernization of an elevator group while maintaining a good level of elevator .service in an occupied building, without impairment of the conveying capacity and with full maintenance of all safety functions. In particular, it is a feature of the present invention that during the modernizing period, all functionally capable elevators operate as a group utilizing the control strategy of the old group control.

It is another advantage that the ITM system saves time and money during modernization since the technical knowledge required for its installation is restricted to wiring to the old and new elevator controls and the call registering devices which can be accomplished with approximately one day of field labor.

Additional advantages of the ITM system are that it is non-invasive to the old relay control so that there is no modification of the old elevator control which continues to operate as originally designed and, because all existing relay functions are maintained, there is no modification of existing safety or control functions. This obviously results in a reduced possibility of liability.

A further feature is that the ITM system is a standard unit which resides on the job site temporarily. It is a reusable tool and its components are inexpensive and reusable too. For that reason, the ITM system adds no additional costs to the modernization of an elevator group.

Furthermore, it has been found to be advantageous that the present invention is programmable and thereby very flexible to use. The routing of hall calls to the original and to the already updated elevators is based on an algorithm which enables the ITM system to route the calls proportionally to the traffic load on each elevator group control.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
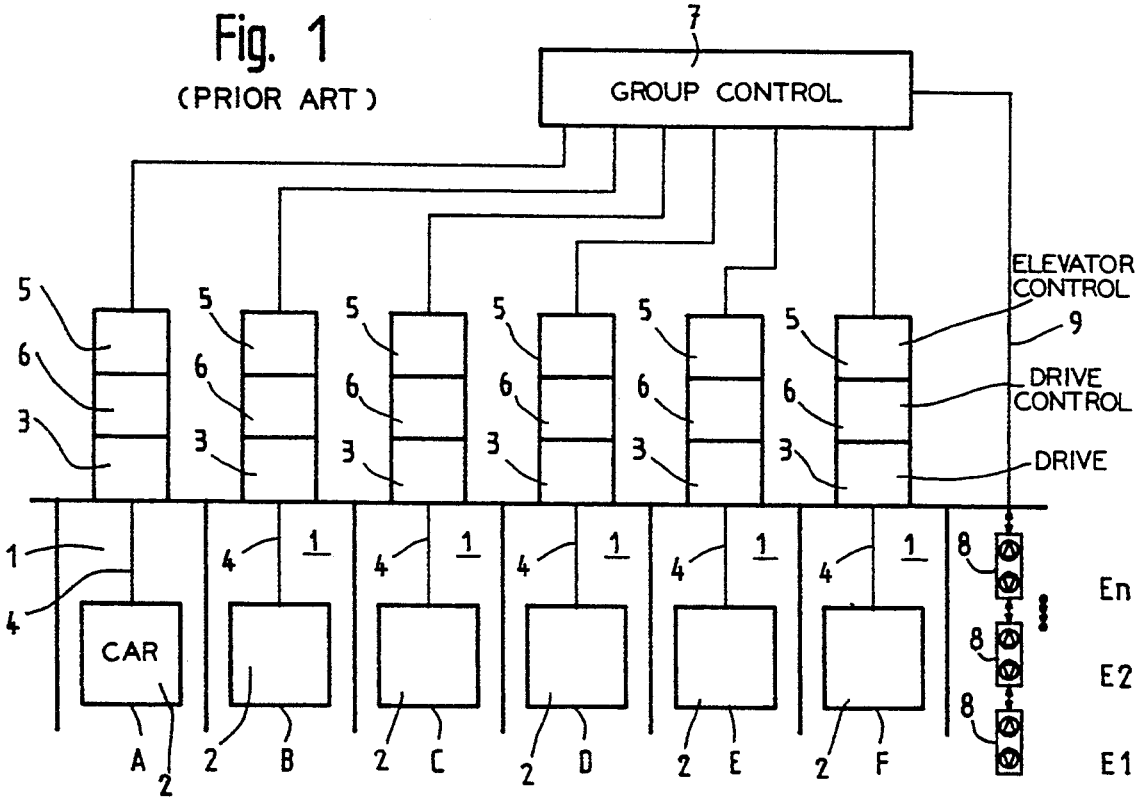
Fig. 1 (PRIOR ART)
FIG. 1 is a schematic block diagram of a plurality of elevators and a conventional elevator group control forming an elevator group to be modernized according to the present invention.

There is shown in the FIG. 1 a known elevator group including elevators A, B, C, D, E, and F each having an elevator car 2 guided in a separate elevator shaft 1. Each of the elevator cars 2 is driven by a drive or hoist motor 3 connected to the car by a hoist cable 4 in order to serve a plurality of floors E1, E2, through En in a building. Each drive 3 is controlled by a separate elevator control microcomputer system 5 connected to the drive 3 through a drive control 6, such as is shown in the European Patent No. 0 026 406, wherein the target value generation, the regulating functions and the start/stop initiation are accomplished. Each of the microcomputer systems 5 is connected with a group control 7 for coordinating the operation of the elevator cars 2. Additional equipment, which is necessary for the operation of the elevators but not illustrated, can include load-measuring devices, devices signaling the respective operational state of the cars 2, a stop indicator, and so forth. Hall calls are entered into the group control 7 through a bus line 9 connected to push button call registering devices 8 located on the floors E1 through En. These calls are allocated to one of the cars 2 according to a predetermined allocation procedure stored in the group control 7.

Figure 2:
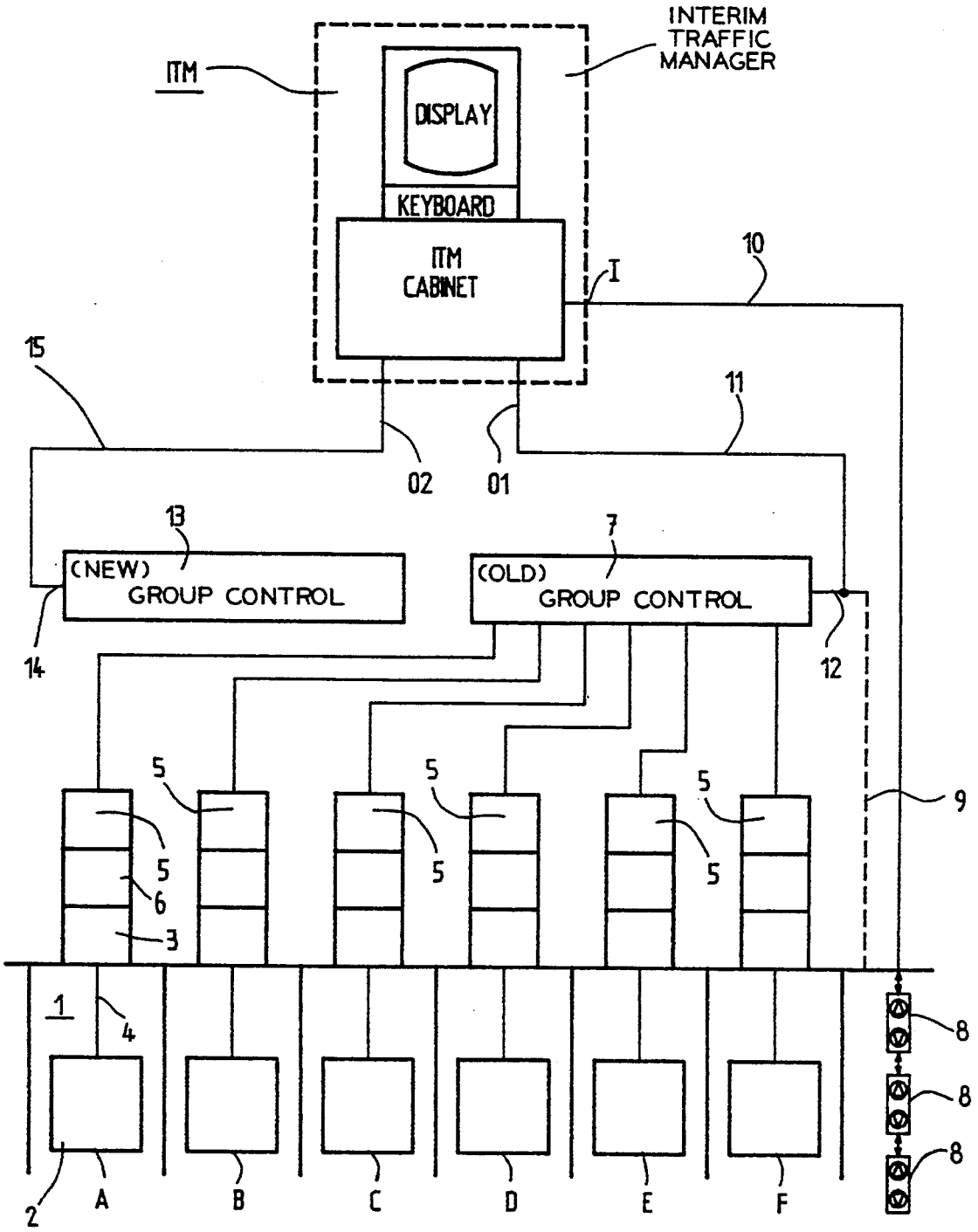
FIG. 2 is a schematic block diagram of the elevator group shown in the FIG. 1 after the execution of the first two modernizing steps in the method according to the present invention whereby an Interim Traffic Manager and a new group control are installed.

The FIG. 2 shows the system configuration of the elevator group N(A, B, C, D, E, F) illustrated in the FIG. 1 after preparatory modernizing steps "a" and "b" have been completed. The step "a" involves integration of an Interim Traffic Manager system into the elevator group to be modernized, wherein an old hall call bus line is disconnected from the old group control and a new hall call bus line is installed and connected to the input of the Interim Traffic Manager, the first hall call output of which is connected to the old group control. The step "b" involves installation of a new group control wherein the hall call input of the new group control is connected with a second hall call output of the Interim Traffic Manager and wherein all elevators in the group are operated by the Interim Traffic Manager and the old group control according to the old control strategy.

As shown in the FIG. 2, an Interim Traffic Manager system ITM serving as modernizing aid is integrated into the elevator group to be modernized. A hall call input I of the system ITM is connected by a new bus line 10 to the existing push button call registering devices 8 and a first hall call output 01 of the system ITM is connected by a data bus 11 with a hall call input 12 of the old group control 7. If the elevators are the older relay control types, the system ITM is connected to the existing relay control dispatcher. In that case, the old bus line 9 (dashed line) is severed from the old group control 7 and the new push button bus line 10 is installed and connected to the system ITM. After this changeover, the elevator group N(A, B, C, D, E, F) functions in the customary manner with the old group control 7, the old elevator controls 5 and according to the old hall call assignment strategy. However, the hall calls are no longer entered directly into the old group control 7, but are entered by way of the system ITM from the hall call registering devices 8 into the old group control 7.

While the elevator group N(A, B, C, D, E, F) is operated functionally unchanged and in the customary manner, the installation of a new group control 13 can take place. A hall call input 14 of the control 13 is connected by a data bus 15 to a second hall call output 02 of the Interim Traffic Manager system ITM. The new group control 13 can thus follow the function of the system ITM, but does not yet control the elevator group or individual elevators.

Figure 3:
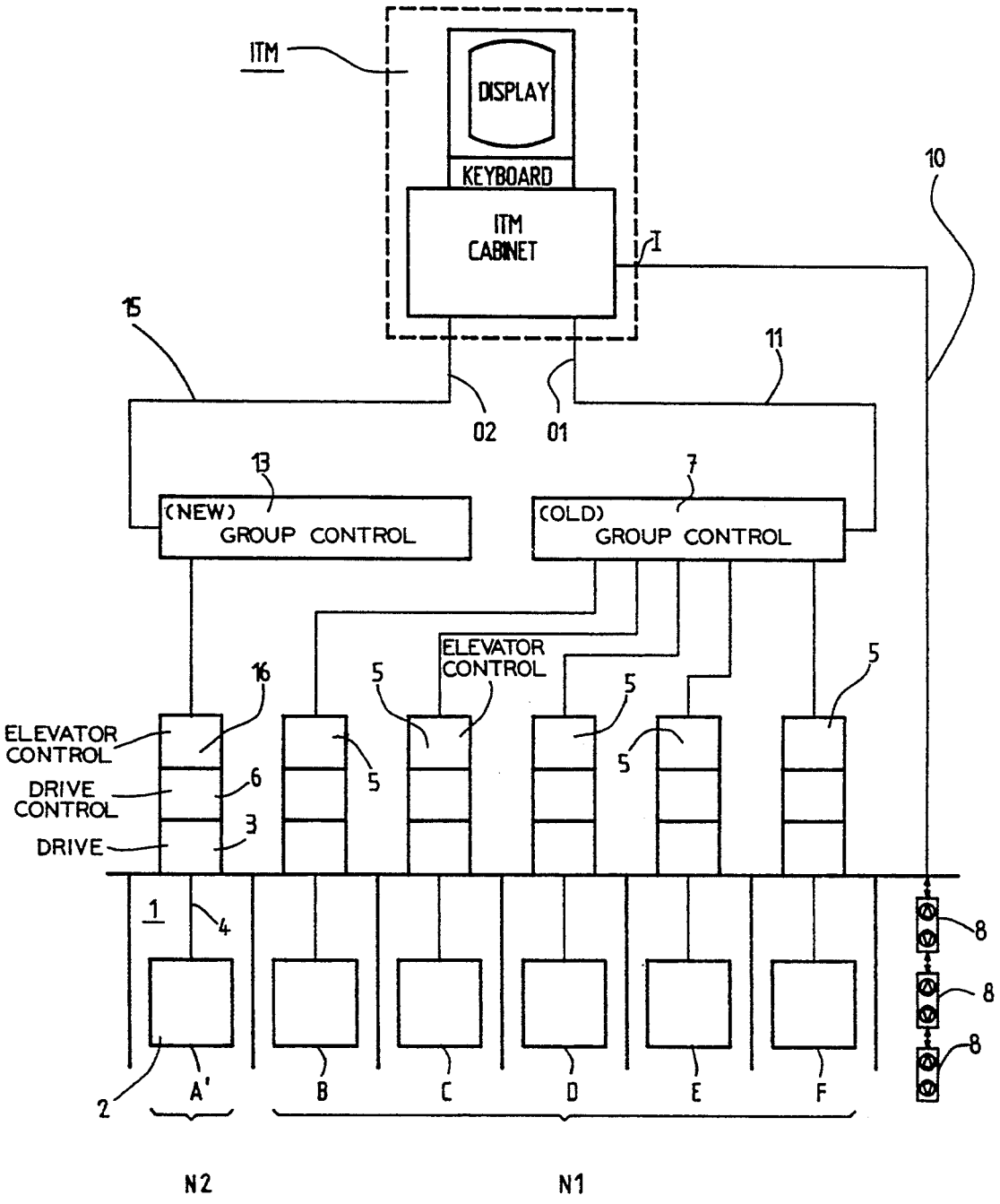
FIG. 3 is a schematic block diagram of the elevator group shown in the FIG. 2 after the execution of three additional modernizing steps in the method according to the present invention by which a first elevator is removed from service, re-equipped and placed back into service.

The FIG. 3 shows the elevator group after a three step process of the removing from service and re-equipment (step "c") , subordination (step "d") and recommissioning (step "e") of a first elevator. In the step "c" , a first elevator of the elevator group is taken out of service and adapted to the new group control while the original, not yet adapted elevators are operated as a first subgroup by the system ITM and under the control of the old group control. In the step "d" , the inputs and the outputs of the new group control are connected to the inputs and outputs of the new elevator control. In the step "e" , the first elevator is recommissioned under the control of the new group control.

In the present example, the elevator A is selected as the first elevator to be modernized. However, any other elevator of the group could have been chosen for this procedure. The elevator A is removed from service and re-equipped wherein the old elevator control 5 shown in the FIG. 2 is replaced by a new elevator control 16 in the course of the modernizing. In the further course of the modernizing process, described below, all the other elevators of the group are successively re-equipped utilizing this three step process, whereby the new elevator controls 16 are added in as the old elevator controls 5 are removed.

During the application of this three step process to the elevator A, the remaining original and not yet re-equipped elevators B, C, D, E and F form a first subgroup N1(B, C, D, E, F) which is reduced by the elevator A and operated in the customary manner and to which all hall calls are assigned by the system ITM. The original elevators B, C, D, E, F are older relay control types connected to the old bus line 9. After recommissioning is complete, a re-equipped elevator A' is under the control of the new group control 13 and the system ITM distributes the hall calls proportionally to the elevator A' under the control of the new group control 13 and to the elevators B, C, D, E and F under the control of the old group control thereby combining all the elevators to function as a single group.

Figure 4:
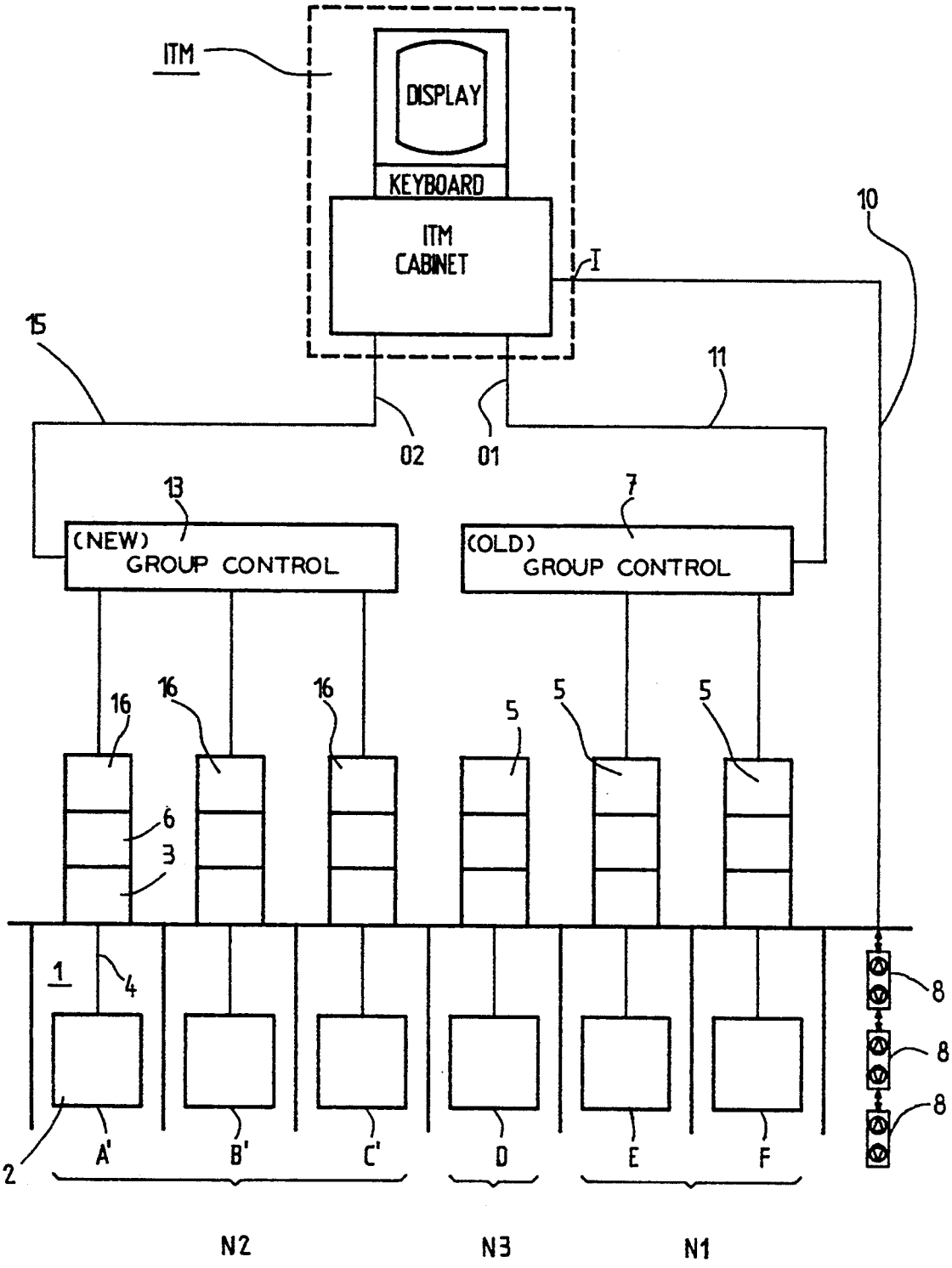
FIG. 4 is a schematic block diagram of the elevator group shown in the FIG. 3 during an intermediate phase of the modernizing method according to the present invention.

The FIG. 4 shows the elevator group during an intermediate phase of the taking out of service and re-equipment, subordination and recommissioning of all other elevators with the exception of the last one in the group. During the modernization of successive ones of the elevators after the elevator A', a second three step process is followed in which a further elevator of the elevator group is removed from service and adapted to the new group control (step "f"), while the original, not yet adapted elevators are operated as a first subgroup by the Interim Traffic Manager and under the control of the old group control and the already adapted elevators are operated as a second subgroup by the Interim Traffic Manager and under the control of the new group control. A second step (step "g") repeats the steps "d" and "e". A third step "h" repeats the steps "f" and "g" until a last, not yet adapted elevator remains in the elevator group.

As is evident from the FIG. 4, the elevator group N(A, B, C, D, E, F) is in this intermediate phase during which the elevator D is subjected to the first and second steps of the second three step process. The elevator group is subdivided into three subgroups, namely the first subgroup Ni(E, F) consisting of the original, not yet reequipped elevators E and F, the second subgroup N2(A', B', C') consisting of the already re-equipped elevators A', B' and C', and a third subgroup N3(D) consisting merely of the elevator D taken out of service and in the process of re-equipment. Both of the subgroups N1 and N2 are functionally capable with the subgroup N2 run according to the new strategy by way of the new group control 13 and the subgroup N 1 run according to the old strategy by way of the old group control 7.

The system ITM knows the traffic loading of both of the subgroups N 1 and N2 through the data buses 11 and 15 respectively and also has further information data about the operational status of the individual elevators A', B', C', E and F. It is therefore possible for the system ITM to allocate the hall calls arriving from the hall call registering devices 8 to the elevators in the subgroups N1 and N2 according to a special strategy and thereby to combine the same into a single group N(A', B', C', E, F) for the hall call allocation.

To allocate incoming hall calls, the system ITM uses a routing algorithm RA. Call or demand routing serves to maintain an equal number of calls per number of cars on each bank of an elevator group, based upon the routing algorithm RA which utilizes the equation:

$$NCO/NSO = NCN/NSN,$$

wherein NCO is the number of hall calls in the old group control, NCN is the number of hall calls in the new group control, NSO is the number of cars in service in the old group control and NSN is the number of cars in service in the new group control.

The system ITM keeps track of the current hall calls in each group control and it also keeps track of the number of cars in service in each group control. If the system ITM receives an incoming hall call from one of the push button hall call registering devices 8, the loading of the cars is checked and the call is routed to the appropriate group control. That group control will see the call and try to acknowledge the call by latching the call in the system and turning on the acknowledge lamp. Since the system ITM will see the "acknowledge lamp" signal, it will keep the lamp at the push button lit until the control cancels the call and turns off the lamp. The system ITM will update its own count of the number of calls and cars in service for each group control. As a general rule, incoming hall calls are always routed to the less loaded one of the group controls 7 and 13. If the controls are equally loaded, routing is random. If no cars are in service in one control, all calls are routed to the other control and, if all cars are out of service, an error message is displayed. In case a control has previously registered calls, these calls are noted, displayed on a screen and included in calculations. Since the new group control 13 and the new elevator controls 16 display an improved efficiency in traffic management, a better hall call allocation is assured for the subgroup N2(A', B', C') than was the case with the previously described prior art methods. The removal from service of the elevator D, as well as the use of parallel group control systems of different strategies, are thereby compensated for to a large extent so that a possible reduction in the conveying capacity or prolongation of the waiting times, if any, might be slight.

Since banks of elevators are usually modernized one or two elevators at a time, a situation is frequently created where there is a mixture of old and new controllers that cannot function together efficiently. With the installation of the system ITM, modernized cars and older cars operate as a single bank of elevators by interfacing directly to the floor push buttons and routing hall calls to either the old or the new group controls. The use of the system ITM results in a better maintained elevator service during modernization jobs.

Figure 5:
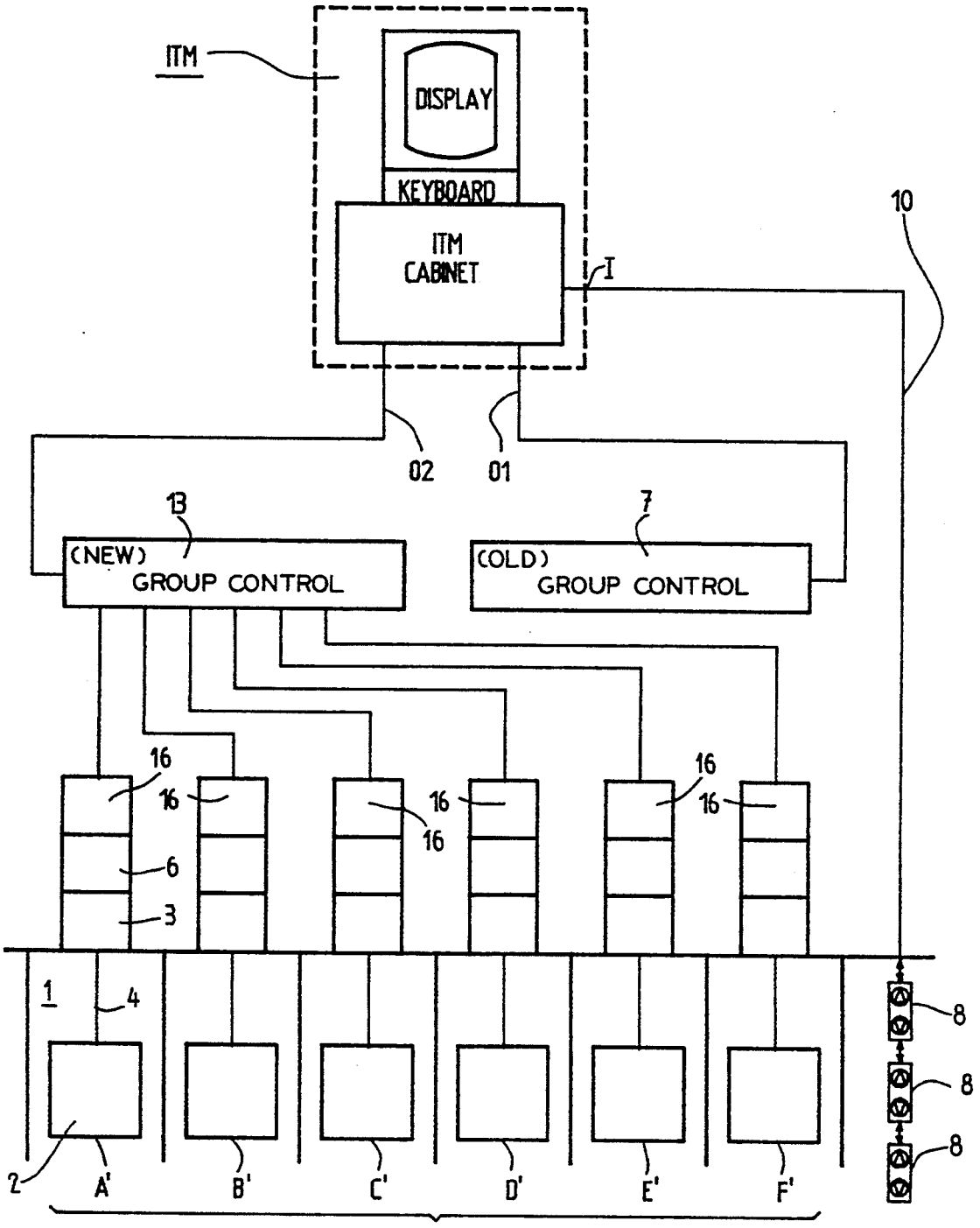
FIG. 5 is a schematic block diagram of the elevator group shown in the FIG. 4 after the last elevator in the group has been modernized by the method according to the present invention.

The modernization of the elevator group is continued as shown in the FIG. 5 in that the last elevator F is modernized according to a step (step "i") of removing the last elevator of the elevator group from service and adapting it to the new elevator group control while the already adapted elevators are operated as the second subgroup by the Interim Traffic Manager and under the control of the new group control, and a step (step "j") of repeating the steps "d" and "e" and operating with the new control. Since the old group control 7 is not connected to the new elevator controls 16 and can accordingly no longer allocate any hall calls for service to the re-equipped elevators A', B', C', D', E' and F', the system ITM directs all hall calls to the new group control 13. The first subgroup NI(A', B', C', D', E', F') is equal to the modernized elevator group N(A', B', C', D', E', F') and is operated by the new group control 13, by way of the new elevator controls 16, and according to a new control strategy. However, the entry of the hall calls still takes place through the system ITM and the old group control 7 is still connected with the first hall call output 01 of the system ITM.

Figure 6:
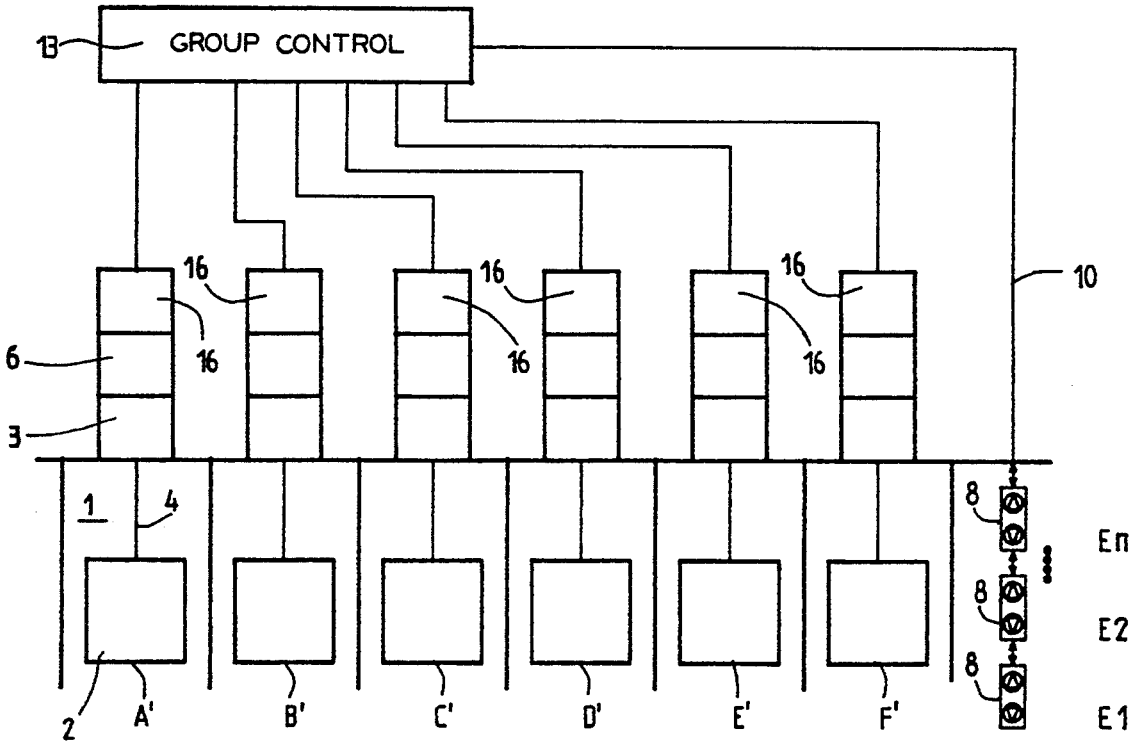
FIG. 6 is a schematic block diagram of the elevator group shown in the FIG. 5 after execution of a final modernizing step in the method according to the present invention wherein the completely modernized elevator group is operated by the new group control.

As shown in the FIG. 6, the modernization of the original elevator group N(A, B, C, D, E, F) is concluded with a step "k". After all of the elevators are updated, the push button bus line 10 is connected to the new group control 13 and the old group control 7 and the system ITM are removed.

Figure 7:
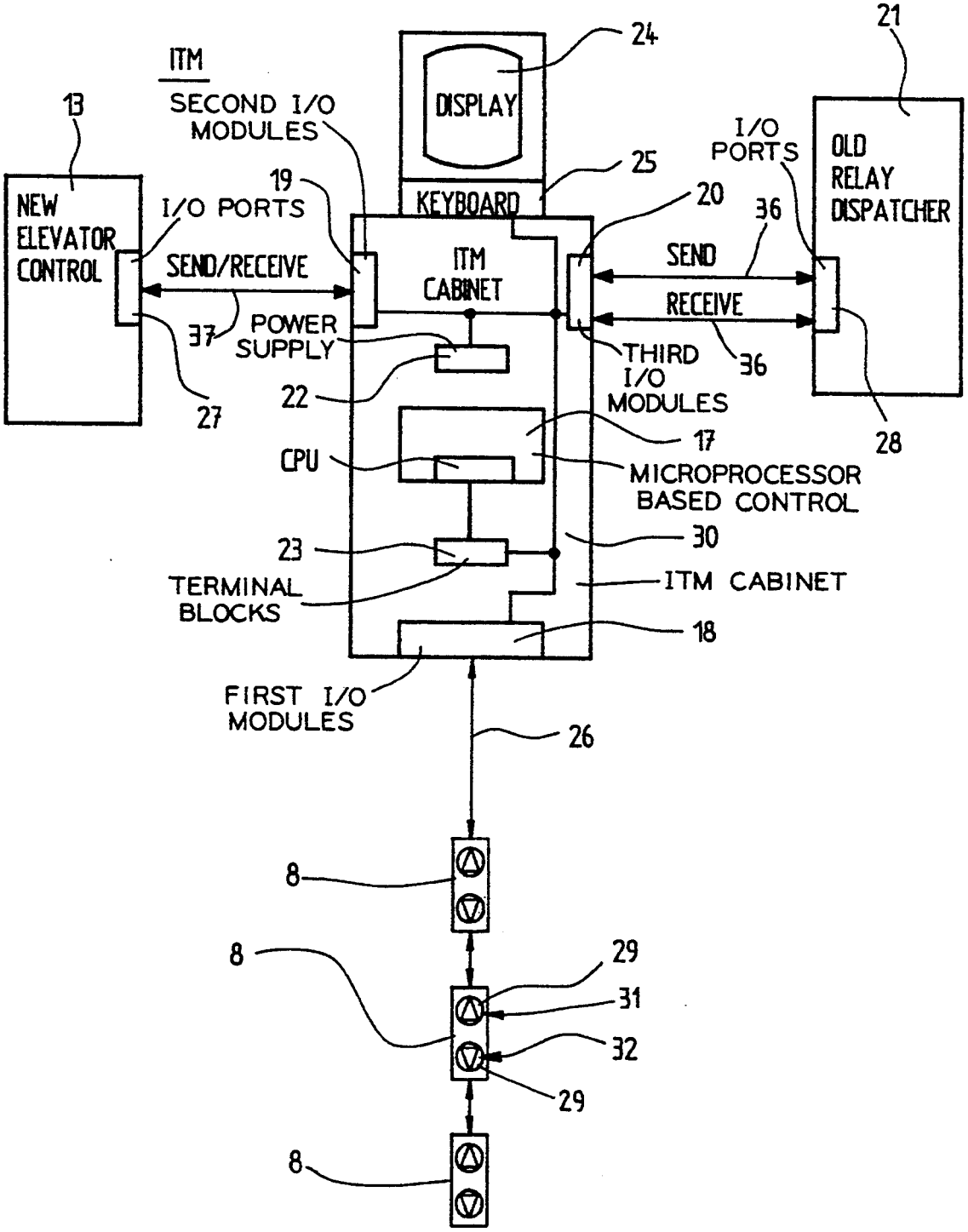
FIG. 7 is a schematic block diagram of the Interim Traffic Manager shown in the FIGS. 2 through 5.

There is shown in the FIG. 7 the Interim Traffic Manager system ITM which has eight main components: a microprocessor-based control 17 with a proprietary software package; a first plurality of I/O modules 18 for interface with the push button hall call registering devices 8; a second plurality of I/O modules 19 for interface with the new elevator group control 13; a third plurality of I/O modules 20 for interface with an old relay group control 21 representing the group control 7; a power supply 22 for the call registering devices 8 and the I/O modules 18, 19 and 20; a plurality of terminal blocks 23 for central location of all connections; a CRT screen 24 for status display; and a keyboard 25 for data entry for use by installation technicians. The main components are installed on or in an associated ITM cabinet 30. The microprocessor-based control 17 is connected to the call registering devices 8 by wiring 26 representing the bus line 10, to a plurality of hall call input/output ports 27 in the new elevator control 13 by wiring 37 representing the data bus 11 and to a plurality of hall call input/output ports 28 in the old relay dispatcher 21 by wiring 36 representing the data bus 15. The control 17 acknowledges actuated push button signals, latches "on" a CRL lamp 29 in an associated one of the call registering devices 8, looks at both group controls 13 and 21 to determine which is the least demand loaded system, and sends the hall call to the least loaded system.

The system ITM provides a simple screen display 24 to indicate its current status. It is by no means a lobby display and, hence, is designed to convey information and not for fancy graphics. The following status messages are displayed: the current location of all hall calls and which group control they are routed to; in-service and out- of-service status for each car 2 of each group control; the current time of day; the number of hall calls routed to each group control; the total number of hall calls in both group controls; and the number of cars 2 in service for each group control.

The general operation of the system ITM can be described as follows: the microprocessor-based control 17 scans the I/O modules 18 for changes in incoming hall call signals. Each of the call registering devices 8 includes an up push button 31 and a down push button 32, each such push button having an associated one of the indicating lamps 29. Although not shown, the device 8 for the highest floor typically has only a down push button 32 and the device for the lowest floor typically has only an up push button 31. If, for example, the up push button 31 has been actuated since the last scan, the control senses the signal change as a hall call signal, latches the hall call signal and turns the associated CRL lamp 32 on. Each subgroup of elevator cars is evaluated for traffic loading. The system ITM then simulates the hall call to the group control of the subgroup which has the lighter loading. The group control of the selected one of the first and second subgroups then selects which car 2 is best able to answer the call. When the call is answered, the group control changes the call state at its CRL lamp output port. The system ITM sees this change and turns off the CRL lamp 29 at the push button hall call registering device 8. The system ITM monitors an In-Bank-Service signal for each elevator (original and updated) which information is used to calculate loading for each subgroup. If a group control accepts a call, the call acknowledge lamp 29 at the device 8 remains lit. On the other hand, if a control will not accept a call (such as when the car is at the associated floor), the call acknowledge lamp 29 at the device 8 is extinguished. This is also the case when a group control cancels a call.

If a control acknowledges a call that the system ITM did not enter, including previously registered calls, the acknowledge lamp 29 at the device 8 is illuminated and calls are no longer accepted for that floor and direction. This allows the system ITM to be connected in parallel to the bus line 9 and still function properly. When a group control cancels a previously registered call, the acknowledge lamp 29 at the device 8 is extinguished. Previous patterns of hall calls have no effect on call routing. Routing is not performed with artificial intelligence, but on the aforementioned criteria which is to maintain an equal number of calls per number of cars in each bank.

The old control I/O modules are interchangeable for various voltages, if necessary. However, the system ITM standard is: inputs=90 to 140 V AC and DC; outputs=5 to 200 V DC. All of the I/O modules 18, 19 and 20 are optically isolated up to 4000 V and are further isolated from each other to accommodate both registration systems: positive (+) common (current sourcing) and negative (−) common (current sinking). This allows the use of AC or DC call registration lamps 29 which can be either independent or interconnected with the push button call registering device 8.

The system ITM stores the proprietary software package in a central processing unit CPU (FIG. 7) which operates to translate changes in signals at the inputs to the I/O modules 18, 19 and 20 into a proprietary message format and the messages are sent to the main body of the system ITM software for routing. Similarly, messages are translated into signal changes at the outputs of the I/O modules 18, 19 and 20. As a result of using internal proprietary messages, the system ITM can be directly connected to an elevator control using a data-link interface. This also allows all messages to be stored in a file, on disk, for later playback and statistical analysis.

Although the method according to the present invention has been described as modernizing the individual elevator cars successively, the cars can be combined into groups and the steps "c", "d", "e", "f" and "i" can be performed group by group. While the invention has been described relative to the modernization of an elevator group, it can be used to modernize any other group of common systems for transporting persons or goods.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for modernizing a group control for an elevator system having a plurality of elevator cars for serving a plurality of floors in a building, the system including hall call registering devices located at the floors for entering hall calls, a group control connected to the hall call registering devices by a bus line and to controls for the elevator cars by a data bus, the group control being responsive to entered hall calls and to signals indicative of conditions of each of the cars for dispatching the elevator cars to serve the hall calls, the method comprising the steps of:

a) integrating an Interim Traffic Manager system into an elevator system to be modernized by disconnecting an existing bus line from a hall call input of an existing group control, installing a new bus line, connecting the new bus line between a hall call input of the Interim Traffic Manager system and existing hall call registering devices, and connecting a first hall call output of the Interim Traffic Manager system to the hall call input of the old group control;

b) installing a new group control in the elevator system, connecting a hall call input of the new group control to a second hall call output of the Interim Traffic Manager system, and operating all elevator cars in the elevator system under the control of the Interim Traffic Manager system and the old group control according to an old control strategy of the old group control;

c) removing a first elevator car of the elevator system from service and adapting the out of service elevator car to an associated new elevator control while operating all other not yet adapted elevator cars of the elevator system as a first subgroup under the control of the Interim Traffic Manager system and the old group control;

d) subordinating the out of service elevator car to the new group control by connecting the new group control to the associated new elevator control;

e) recommissioning the out of service elevator car under the control of the new group control;

f) removing another elevator car of the elevator system from service and adapting the out of service another elevator car to an associated new elevator control while operating all other not yet adapted elevator cars of the elevator system as the first subgroup under the control of the Interim Traffic Manager system and the old group control and operating all of the already adapted elevator cars of the elevator system as a second subgroup under the control of the Interim Traffic Manager system and the new group control;

g) repeating the steps d) and e);

h) repeating the steps f) and g) until a last, not yet adapted elevator car of the elevator system remains;

i) removing the last elevator car of the elevator system from service and adapting the out of service last elevator car to an associated new elevator control while operating all of the already adapted elevator cars of the elevator system as the second subgroup under the control of the Interim Traffic Manager system and the new group control;

j) repeating the steps d) and e); and k) disassembling the Interim Traffic Manager system and the old group control from the elevator group and connecting the old bus line with the hall call input of the new group control.

2. The method according to claim 1 wherein individual elevator cars of the elevator system are combined into groups and the steps c), d), e), f) and i) are performed group by group.

3. The method according to claim 1 including responding to an entered hall call by selecting the one of the first and .second subgroups having the lighter loading and causing the Interim Traffic Manager system to simulate the entered hall call at the hall call input of the group control of the selected subgroup.

4. The method according to claim 1 including monitoring all entered hall calls for cancellation with the Interim Traffic Manager system and, when one of the entered hall calls is cancelled, switching off a lamp associated with the call registering device at which the one entered hall call was entered.

5. The method according to claim 1 including storing a routing algorithm in a central processing unit of the Interim Traffic Manager system, operating the central processing unit to evaluate the first and second subgroups of elevator cars for traffic loading and routing an entered hall call to the group control of the one of the subgroups having the lighter loading.

6. An apparatus for modernizing an existing group control of an elevator system having a plurality of elevator cars for serving a plurality of floors in a building, the system including hall call registering devices located at the floors for entering hall calls, an old group control connected to the hall call registering devices by a bus line and to elevator controls for the elevator cars by a data bus, the old group control being responsive to entered hall calls and to signals indicative of conditions of each of the cars for dispatching the elevator cars to serve the hall calls, the apparatus comprising:

an interim traffic manager system having a hall call input, a first hall call output and a second hall call output, said interim traffic manager system receiving entered hall calls for a group of elevators at said hall call input, the elevators each having an elevator control for connection to an old group control, at least one of the elevator controls being connected to the old group control and at least another one of the elevator controls previously connected to the old group control being connected to a new group control, said interim traffic manager system routing each of the hall calls to one of the old group control and the new group control through a corresponding one of said first and second hall call outputs;

a bus line connected between said hall call input and existing push button call registering devices for transmitting the hall calls;

a first data bus connected between said first hall call output of said interim traffic manager system and a hall call input of the old group control for transmitting the routed hall calls; and a second data bus connected between said second hall call output of said interim traffic manager system and a hall call input of the new group control for transmitting the routed hall calls.

7. The apparatus according to claim 6 wherein said interim traffic manager system includes a microprocessor-based control having a central processing unit for allocating entered hall calls to the old and new group controls in accordance with a routing algorithm stored in said central processing unit, said microprocessor-based control being connected to said hall call input, said first hall call output and said second hall call output.

8. The apparatus according to claim 7 wherein said interim traffic manager system includes a plurality of input-output modules connected by said bus line as an interface between said microprocessor-based control and the existing call registering devices.

9. The apparatus according to claim 8 wherein said input/output modules are isolated from one another to accommodate current-sourcing and current-sinking call registration systems and to allow the use of AC or DC call registering acknowledgement lamps.

10. The apparatus according to claim 7 wherein said interim traffic manager system includes a plurality of input-output modules connected as an interface between said microprocessor-based control and the new group control.

11. The apparatus according to claim 7 wherein said interim traffic manager system includes a plurality of input-output modules connected as an interface between said microprocessor-based control and the old group control.

12. The apparatus according to claim 7 wherein said interim traffic manager system includes a display connected to said microprocessor-based control for displaying information about the elevator system.

13. The apparatus according to claim 7 wherein said interim traffic manager system includes a keyboard connected to said microprocessor-based control for entering data into said microprocessor-based control.

14. The apparatus according to claim 7 wherein said interim traffic manager system allocates entered hall calls between the old and new group controls when each of the old and new group controls has at least one elevator car of the elevator system connected thereto.

15. The apparatus according to claim 7 wherein said interim traffic manager system allocates entered hall calls between the old and new group controls according to a routing algorithm which utilizes an equation NCO/NSO=NCN/NSN, wherein NCO is the number of hall calls in the old group control, NCN is the number of hall calls in the new group control, NSO is the number of elevator cars in service in the old group control and NSN is the number of elevator cars in service in the new group control.

16. An apparatus for modernizing a group control of an elevator system having a plurality of elevator cars for serving a plurality of floors in a building, the system including hall call registering devices located at the floors for entering hall calls, an old group control connected to the hall call registering devices by a bus line and to controls for the elevator cars by a data bus, the old group control being responsive to entered hall calls and to signals indicative of conditions of each of the cars for dispatching the elevator cars to serve the hall calls, the apparatus comprising:

a microprocessor-based control having an input, a first output, a second output and a central processing unit for allocating entered hall calls for a group of elevators in accordance with a routing algorithm to an old group control and to a new group control, each of the elevators having a control with the old group control being connected to at least one of the elevator controls and the new group control being connected to at least another one of the elevator controls previously connected to the old group control, said central processing unit generating the hall calls allocated to the old group control at said first output and the new group control at said second output;

a first plurality of input-output modules connected at said microprocessor-based control input as an interface to existing push button call registering devices for receiving entered hall calls for the elevators, each of said input/output modules of said first plurality being isolated from one another to accommodate current-sourcing and current-sinking call registration systems and to allow the use of AC or DC call registering acknowledgement lamps;

a second plurality of input-output modules connected at said microprocessor-based control second output as an interface to an input of the new group control;

a third plurality of input-output modules connected at said microprocessor-based control first output as an interface to an input of the old group control;

a display and keyboard connected to said microprocessor-based control; and a pair of data buses connecting said second plurality of input-output modules with the new group control input and said third plurality of input-output modules with the old group control input.

* * * * *